US005437610A

United States Patent [19]

Cariapa et al.

[11] Patent Number: 5,437,610

[45] Date of Patent: Aug. 1, 1995

[54] EXTREMITY PUMP APPARATUS

[75] Inventors: Vikram Cariapa, Franklin; Dean C. Jeutter, Grafton; Shih-Kang Liang, Milwaukee, all of Wis.

[73] Assignee: Spinal Cord Society, Fergus Falls, Minn.

[21] Appl. No.: 179,519

[22] Filed: Jan. 10, 1994

[51] Int. Cl.[6] ..... A61H 9/00

[52] U.S. Cl. ..... 601/152; 601/150; 128/DIG. 20

[58] Field of Search ..... 601/148–152; 602/13; 128/DIG. 20

[56] References Cited

U.S. PATENT DOCUMENTS

| | | | |
|---|---|---|---|
| 3,734,087 | 5/1973 | Sauer et al. | 601/152 |
| 3,853,118 | 12/1974 | Schendel | 128/782 |
| 4,013,069 | 3/1977 | Hasty | 128/DIG. 20 |
| 4,122,837 | 10/1978 | Leonard | 128/774 |
| 4,331,133 | 5/1982 | Arkans | 128/DIG. 20 |
| 4,370,975 | 2/1983 | Wright | 128/DIG. 20 |
| 4,502,470 | 3/1985 | Kiser et al. | 128/DIG. 20 |
| 4,624,244 | 11/1986 | Taheri | 601/152 |
| 5,014,681 | 5/1991 | Neeman et al. | 128/DIG. 20 |
| 5,031,604 | 7/1991 | Oye | 601/150 |

FOREIGN PATENT DOCUMENTS

| | | | |
|---|---|---|---|
| 1250293 | 8/1986 | U.S.S.R. | 601/151 |

OTHER PUBLICATIONS

Mulder, Robinson, Seeley, "Study of Sequential Compression Therapy in the Treatment of Non-Healing Chronic Venous Ulcers,: Wounds: A Compendium of Clinical Research and Practice", vol. 2, No. 3, May/-Jun. 1990.

Pekanmaki, Korai, Kiistala, "Intermittent Pneumatic Compression Treatment for Post-Thrombotic Leg Ulcers," Clinical and Experimental Dermatology, 1987, vol. 12, pp. 350–353.

Pekanmake, Korari, "Sequential and Graded Intermitted Pneumatic Compression Device for Treatment of Swollen Limbs," Biomed Technik, 1987, vol. 32, pp. 50–54.

Richardman, D. M., O'Donnell, T. F. Jr. and Zelikovski, A. "Sequential Pneumatic Compression for Lymphedema," Arch Surg 1985, 120, pp. 1116–1119.

Smith, P. D., Sarin, S., Hasty, J. and Scurr, J. H., "Sequential Pneumatic Compression Enhances Venous Ulcer Healing: A Randomized Trial," Surgery, Nov. 1990, vol. 108, No. 5, pp. 871–875, St. Louis.

Sorenseon, M. K., "The Edematus Hand," Phys Ther, 1989, pp. 1059–1064.

Sedborg, I., "Effectiveness of Combined Methods of Physiotherapy for Post-Mastectomy Lymphoedema": Scand, J. Rehab Med, 1980, vol. 12, pp. 77–85.

Hemaflo, 1986, by Camp, 6 pp. Product Brochure.

Lympha press, 1990, by Camp 12 pp. Product Brochure.

(List continued on next page.)

*Primary Examiner*—Richard J. Apley
*Assistant Examiner*—Jeanne M. Clark
*Attorney, Agent, or Firm*—Palmatier, Sjoquist & Helget

[57] ABSTRACT

A portable, hydraulic extremity pump apparatus for treatment of edema is disclosed. The apparatus consists of a flexible compression unit that wraps around an individual's extremity. The compression unity has a plurality of prefill bladders each containing a separate compression bladder. The bladders are connected to a hydraulic pump through valves. Pressure sensors are connected to prefill bladders. The valves, the pump and the pressure sensors are all connected to a programmable control processor to operate the valves and pump and to monitor the bladder pressures. The valves to the prefill bladders are closed at an appropriate pressurization and the pump is shut down to mold the compression unit around the extremity. The occurrence of edema may then be detected by the monitoring of the pressure in the prefill bladders. Upon detecting an increase in pressure, indicating edema, the control processor activates the pump and opens the valves connected to the compression bladders in a sequential manner to create a sequential pressurization and a wave of compression moving proximally on the extremity. The pressure sensors and control processor continue to monitor the pressures after each wave of compression.

18 Claims, 9 Drawing Sheets

OTHER PUBLICATIONS

Instruction brochure, Lympha press, by Camp 8 pp.
"Chronic Venous Insufficiency" 1990, by Chattanooga, 4 pp. Product Brochure.
Flowpress Home Care Compression Systems, 1990 by Huntleigh, 17 pp. Product Brochure.
Jobst Air Band, 1974, by Jobst. 3 pp. Product Brochure.
"The Vascular Compression System Home Rx", 1991 by Kendall, 2 pp., Product Brochure.
Multicom, Intermittent & Sequential Compression Systems by Talley, 5 pp. Product Brochure.
Wright Linear Pump, 1988, by Wright, 14 pp. Product Brochure.
"Changes in Posttraumatic Ankle Joint Mobility, Pain, and Edema Following Intermittent Pneumatic Compression Therapy,": Airaksinen, O., Arch Phys Med Rehabil, Aug. 1991, vol. :72. pp. 667–670.
Airaksinen, O., Kolari, P. J., and Miettinen, H., "Elastic Bandages and Intermittent Pneumatic Compression Tretment of Acute Ankle Sprains," Arch Phys Med Rehabil, May 1990, vol. 71, pp. 380–383.
Bastien, M. R., and Goldstein, B. G., "Treatment of Lymphedema with a Multicompartmental Pneumatic Compression Device," Journal of the American Academy of Dermatology, May 1989, vol. 20, pp. 853–854.
Cotton, L. T., and Roberts, V. C., "The Prevention of Deep Vein Thrombosis with Particular Reference to Mechanical Methods of Prevention," Surgery, Feb. 1977, vol. 20, pp. 853–854.
Francois, A., Richaud, C., Bouchet, J. Y., Franco, A., and Comet, M., "Does Medical Treatment Act by Increasing Lymph Flow," VASA, 1989, Bank 81, Heft 4, pp. 281–286.
Feeder, J. A., Kloth, L. C., and Gentzkow, G. D., "Chronic Dermal Ulcer Healing Enhanced with Monophasic Electrical Stimulation," Physical Theraphy, Sep. 1991, vol. 71, No. 9, pp. 639–649.
Hardy, J. R., "Lymphedema–Prevention Rather than Cure," Annals of Oncology, 1991, vol. 2, pp. 532–533.
Hazarika, E. Z., and Frazer–Moodie, A., "The Effect of Intermittent Pneumatic Compression on the Hand After Fasciectomy," The Hand, 1979, vol. 11, No. 3, 1979.
McCulloch, J. M., "Intermittent Compression for the Treatment of a Chronic Stasis Ulceration," Physical Therapy, Oct. 1981, vol. 61, No. 10, pp. 1452–1453.
Mridha, M., and Odman, S., "Fluid Translocation Measurement," Scand J. Rehab Med. 1989, vol. 21, pp. 63–69.
Newman, G., "Which Patients with Arm Edema are Helped by Intermittent External Pneumatic Compression Therapy," Journal of the Royal Society of Medicine, Jul. 1988, vol. 81, pp. 377–379.
Raines, J. K., O'Donnell Jr., T. F. Kallsher, L., and Clement Darling, R., "Selection of Patients with Lymphedema for Compression Therapy," The American Journal of Surgery, Apr. 1977, vol. 133, pp. 430–437.
Zelikovski, A., Deuthch, A., and Reiss, R., "The Sequential Compression Device in Surgery for Lymphedema of the Limbs," J. Cardiovase. Surg., 1983, pp. 122–126.
Swedborg, I., "Voluminometric Estimation of The Degree of Lymphedema and Its Therapy by Pneumatic Compression," Scand J. Rehab Med, 1977, vol. 9, pp. 131–135.
Swedborg, I., "Effects of Treatment with an Elastic Sleeve and Intermittent Pneumatic Compression in Post–Mastectomy Patients with Lymphedema of the Arm," Scand J. Rehab Med., 1984, vol. 16, pp. 35–41.
Beninson, Levin, Santiago, Paparao, Bobola, "Use of Intermittent Pneumatic Compression in Hemodialysis," Proc Dialysis Transplant Forum, 1974, vol. 4, pp. 209–213.
Baulleu, Baoulier, Vailant, "Factorial Ananlysis in Radionuclide Lymphography" Assessment of The Effects of Sequential Pneumatic Compression, Lymphology, Dec. 1989, vol. 22, No. 4, pp. 178–185.
Griffin, Newsome, Stralka, Wright, "Reduction of Chronic Posttraumatic Hand Edema: A Comparison of High Voltage Pulsed Current, Intermittent Pneumatic Compression, and Placebo Treatment," Physical Therapy, May 1990, vol. 70, No. 5, pp. 279–286.
Airakisinen, Kolari, Herve, Holopainen, "Treatment of Post–Traumatic Edema in Lower Legs Using Pneumatic Intermittent Compression," Scan J. Rehab Med, 1988, vol. 20, pp. 25–28.
Airaksinen, Partanen, Kolari, Soimakallio, "Intermittent Pneumatic Compression Therapy in Posttraumatic Lower Limb Edema: Computer Tomography and Clinical Measurements," Arch Phys Med Rehab, Aug. 1991, vol. 72, pp. 667–670.
Allenby, Calnan, Pflug, "The Use of Pneumatic Compression in the Swelling Leg," Physiological Society, Feb. 1973, pp. 65–66.

EXTREMITY PUMP APPARATUS

BACKGROUND OF THE INVENTION

The human cardiovascular system is composed of the heart and blood vessels through which blood moves nutrients to cells, tissues and organs, and carries metabolic products away for use or disposal. Since the capillaries are porous, there is a continual exchange of nutritive and waste materials between the blood stream and the body tissues. There is also a continual net flow of plasma fluid out through the capillary walls, adding to the tissue fluid. The blood vessels in the microcirculation region can reabsorb some of the lost fluid, but excess fluid and some plasma protein is returned to the venous circulation path via an elaborate system of collecting vessels, called the lymphatic system. Proper functioning of the lymphatic and muscle pump systems ensures that excessive lymph will not accumulate in the lower extremities. This is important since accumulation of lymph leads to edema with side effects of pain, fibrotic tissue changes, dermal ulceration, infection and, possibly, loss of limb. When trauma or paralysis prevents a patient from exercising the legs, the natural pumping action of the calf muscles is lost, and the result can be lymphedema and tissue fibrosis. Thus, people who are most likely to have lymphedema are sedentary adults such as those recovering from surgeries and those with spinal cord injuries. Lymphedema can also lead to more serious effects such as venous stasis with secondary deep venous thrombosis (DVT). In turn, DVT may lead to life threatening pulmonary embolism. Since DVT has the greatest possibility of occurring in a patient within 90 days of a spinal cord injury, it is advantageous for treatment of edema begin during this period. Generally, it is highly advantageous to treat edema as it is occurring or as soon as possible thereafter.

Where the treatment for edema is not commenced upon occurrence, treatment to reduce the swelling can be lengthy and uncomfortable for patients.

All prior art compression devices known to the inventors operate pneumatically, are bulky, are not portable, and are not responsive to edema levels. That is, none of the devices function to monitor the edema or sense the occurrence of edema for initiating the compression.

SUMMARY OF THE INVENTION

A portable, hydraulic extremity pump apparatus for treatment of edema is disclosed. The apparatus consists of a flexible compression unit configured to wrap around an individual's extremity. The compression unit has a plurality of annular compartments. Each compartment contains a prefill bladder and a compression bladder which are connected to a hydraulic pump for pressurizing the bladders. Prefill control valves are inserted between the pump and each prefill bladder and similarly compression control valves are inserted between the hydraulic pump and each compression bladder. Pressure sensors are connected to prefill bladders. The control valves and pressure sensors are connected to a programmable control processor to operate the valving and monitor the bladder pressures. The prefill bladders are pressurized by way of operating the hydraulic pump and opening the prefill valves until an appropriate pressurization is achieved. The prefill valves are then closed and the pump shut down with the compression unit molded around the extremity. The occurrence of edema is then detected by the monitoring of the pressure in the prefill bladders by way of the pressure sensors and control processor. Upon detecting an increase in pressure, the control processor activates the pump and opens the compression control valves in a sequential manner beginning with the control valve connected to the most distal bladder with respect to the extremity. This causes a sequential pressurization and creates a wave of compression moving proximally on the extremity. After each sequence the compression control valves are opened and the compression control valves are depressurized. The pressure sensors and control processor continue to monitor the pressures after each wave of compression to detect any reduction in the edema to determine whether to continue additional sequential pressurizations. The characteristics of the pumping action and the edema detection are controllable and programmable by way of the control processor for meeting individual patient needs.

A principal feature and advantage of the invention is that the compression of the extremity is provided by hydraulic means as opposed to pneumatic means providing easier maintenance, quieter operation and facilitating the portable nature of the apparatus. Leaks are readily detectable and easily repaired.

An additional feature and advantage of the invention is that the invention continually monitors the edema and controls the operation of the device based on the existence of edema.

A feature of the invention is that the pumping parameters are sequencing are easily programmable into the apparatus and readily changeable.

A principal feature and advantage of the invention is that the invention provides sequential pumping action to create a wave of compression moving proximally on the extremity.

An additional advantage and feature of the device is that it is programmable to provide a gradient of pressure in the different bladders, with the more distal bladders having the higher pressures.

DETAILED DESCRIPTION OF THE PREFERRED EMBODIMENTS

Figure 1:
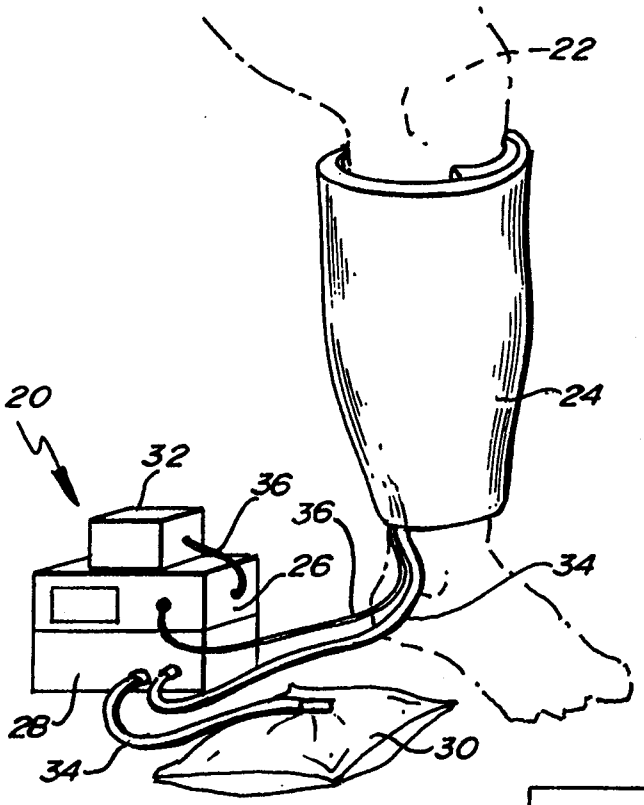
FIG. 1 shows a perspective of the extremity compression apparatus in position on an individual's leg.

Referring to FIG. 1, a perspective view of the portable, hydraulic extremity pump apparatus is shown, designated by the numeral 20, and is shown as it is intended to be placed on an individual's extremity. The apparatus is comprised principally of a compression unit 24, a control processor unit 26, a pump unit 28, a fluid reservoir 30, and a battery 32 to provide power to the control processor unit 26 and pump unit 28. Also shown is tubing 34 connecting the reservoir 30 with the pump unit 28 and the compression unit 24. Similarly, cables 36 connect the compression unit 24 to the control processor unit 26.

Figure 2:
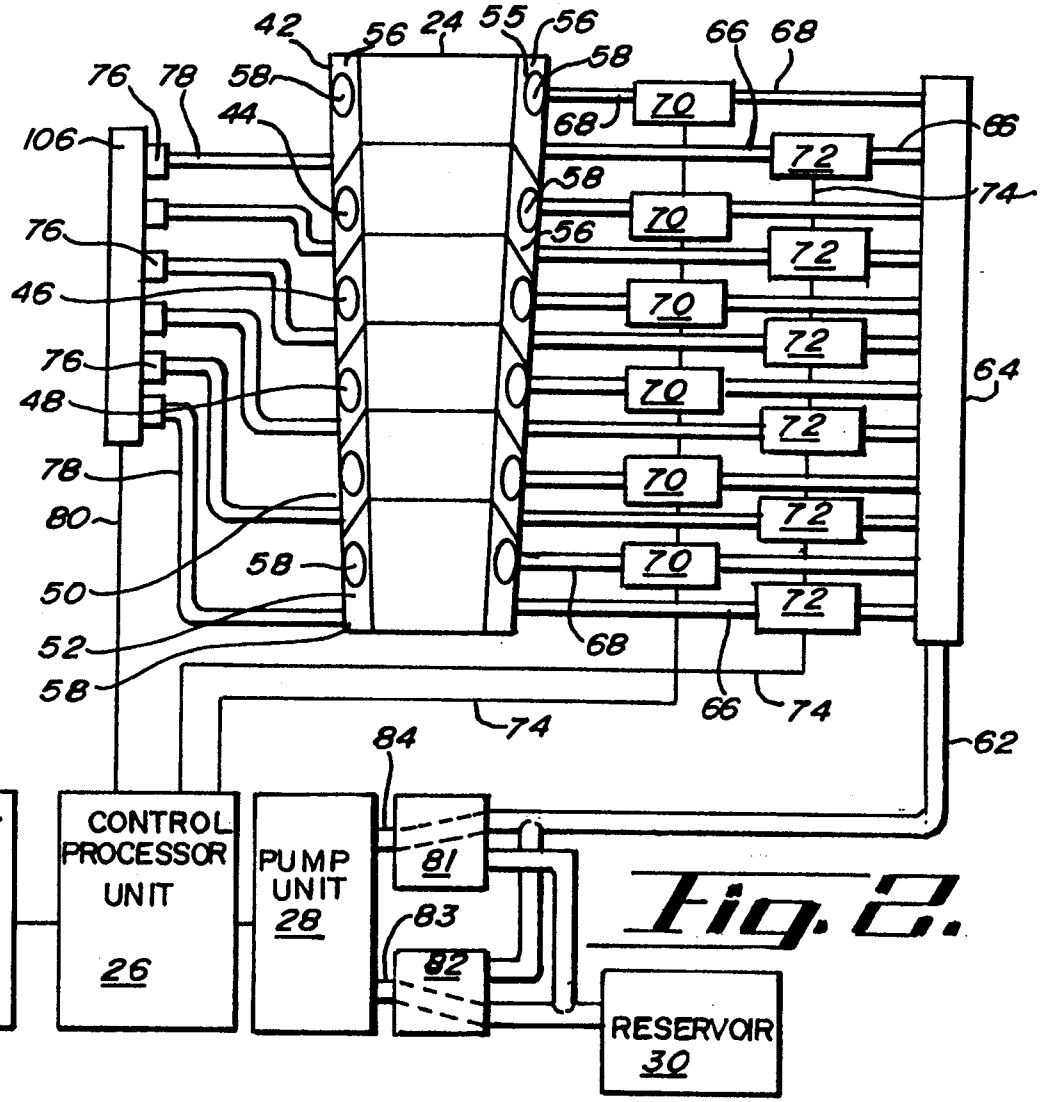
FIG. 2 shows a diagrammatic view of the apparatus including a cross-sectional view of the compression unit showing the prefill bladders and compression bladders.

FIG. 2 shows a block diagrammatic view of the apparatus 20 including a sectional diagram of the compression unit 24. The compression unit 24 is depicted in the hollow, substantially cylindrical or frustoconical shape designed to suit the individual extremity as it would appear in place on an individual's extremity. The compression unit 24 is shown to have six compartments 42, 44, 46, 48, 50, 52 including a most distal compartment 52 and a most proximal compartment 42. Each compartment contains a dual bladder 55 comprising an outer prefill bladder 56 and an inner compression bladder 58. The prefill bladders 56 and the compression bladder 58 are connected to the hydraulic pump 28 by way of connecting line 62, manifold 64, prefill flow line 66, and compression flow lines 68. Compression control valves 70 are inserted in the compression flow lines 68 to control the pressurization of the compression bladders 58. Similarly, prefill control valves 72 are inserted in the prefill flow lines 66 providing for control of the pressurization of the prefill bladders 56. The compression control valves 70 and the prefill control valves 72 are electrically connected to and controlled by the control processor unit 26 by way of electrical cables 74. Also connected to the prefill bladders are pressure sensors 76 which are connected by way of flow lines or tubes 78. The pressure sensors also are electrically connected to the control processor unit by way of electric cables 80. Three-way valves 81, 82 connect to the inlet 83 and outlet 84 of the pump unit 28 to alternately allow either filling or draining of the bladders and reservoir 30.

Figure 3:
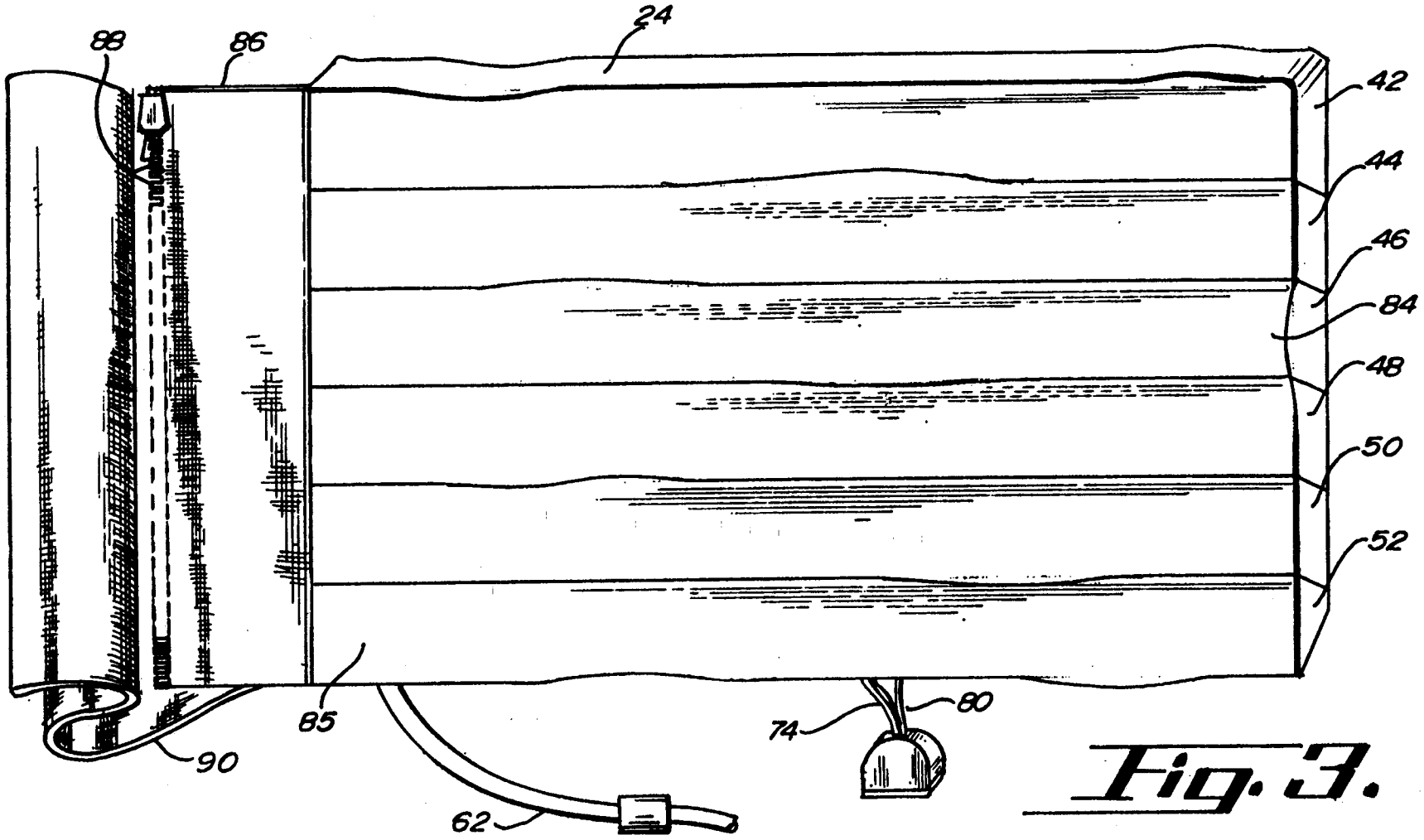
FIG. 3 shows an elevational view of the compression unit in an expanded view revealing the inside face that contacts the individual's extremity.

Referring to FIG. 3, the compression unit 24 that wraps around the individual's extremity is shown in an unwrapped position. The compression unit is depicted showing its inside face 85 which comes into contact with the extremity. The compression unit includes a securing flap 86 with a zipper 88 attached to the end and a cover flap 90 which is attached on the side opposite the inside face 85. The flow line 62 and the connecting cables 74, 80 are shown extending upwardly from the side opposite the inner surface 84. Also depicted in FIG. 3 is the configuration of the compartments in the compression unit 24 which in cross section are roughly parallelogram or trapezoidal in shape. Notably each compartment and bladder slightly overlap the adjacent compartment and bladder.

Figure 4:
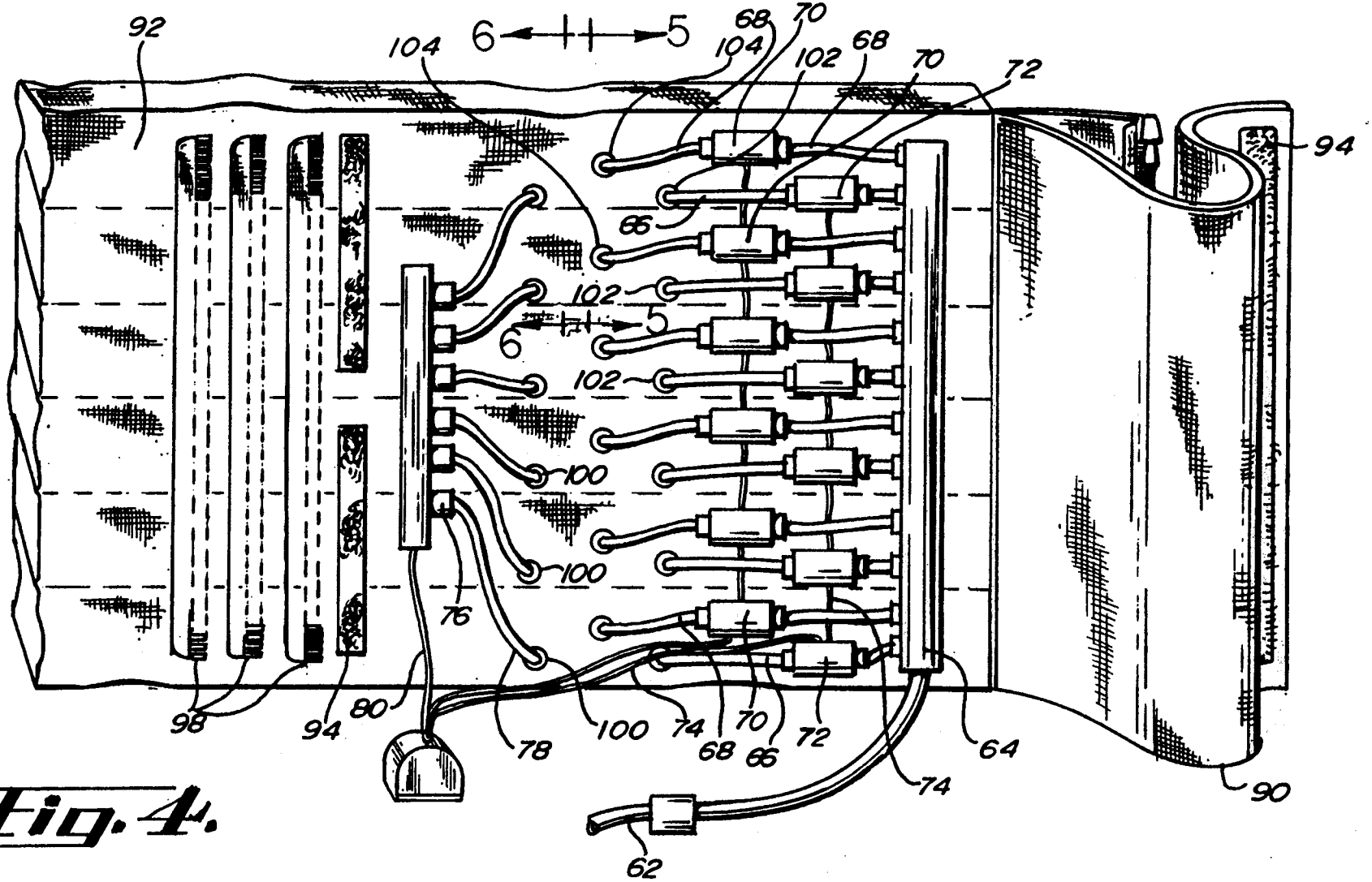
FIG. 4 shows an elevational view of the outside of the compression unit exposing valves and tubing.

Referring to FIG. 4, the outside surface 92 of the compression unit 24 is shown. Positioned on the outside surface 92 of the compression unit 24 is the manifold 64, the prefill control valves 72, the compression control valves 70, and the pressure sensors 76. The valves, sensors, and manifold may be mounted on the outside surface 92 by any convenient method such as straps or hook and loop material. The cover 90, shown in an open position, folds over to cover the valve sensors, tubing and wiring. The cover may be fastened by any convenient means such as hook and loop material 94 attached to the flap with cooperating hook and loop material 94 on the outside surface 92. Also mounted on the outside surface of the compression unit 24 are zipper strips 98 allowing for adjustability in the wrapping of the compression unit around the extremity. Hook and loop material may be substituted for the zipper straps.

Continuing to refer to FIG. 4, the tubes extending from the pressure sensors 76 attach into the prefill bladder connecting point 100 by way of flow lines 78. The prefill control valves 72 connect into the prefill bladder at connecting points 102 by way of flow lines 68. The compression control valves 70 are connected into the compression bladders 58 at connecting points 104 by way of the flow lines 66. The pressure sensors 76 are shown mounted on a circuit board 106. The compression unit may be comprised of a fabric such as fine nylon or similar materials for fabrication of the compartments 42, 44, 46, 48, 50, 52 flap 86 and cover 90.

Figure 5:
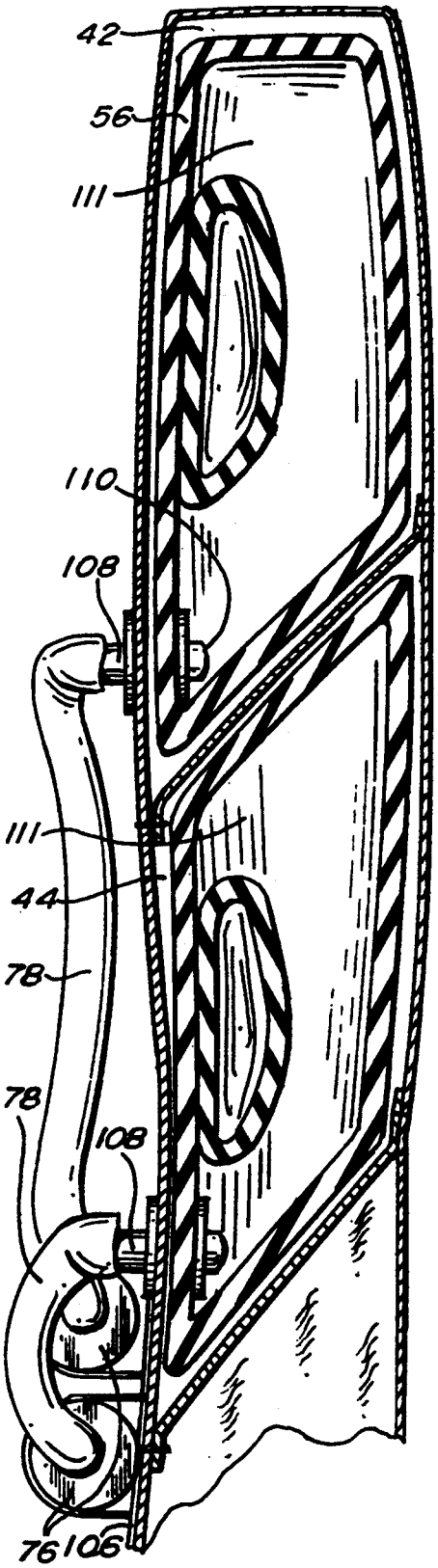
FIG. 5 shows a cross-sectional of the compression unit take at line 5—5 of FIG. 4.
Figure 6:
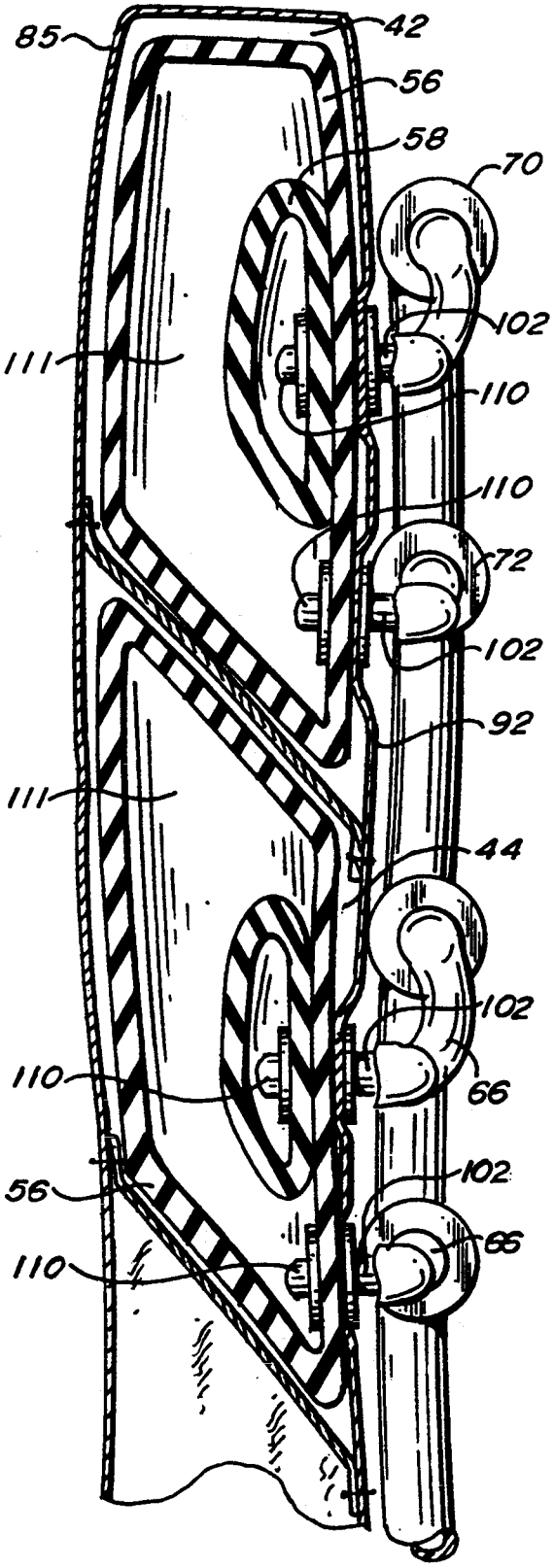
FIG. 6 shows a cross-sectional view of the compression unit taken at line 6—6 of FIG. 4.

Referring to FIGS. 5 and 6, cross-sectional views are shown of the compression unit 24 taken at lines 5—5 and 6—6 respectively. These views further detail the configuration of the compartments, the prefill bladders 56 and the compression bladders 58. The bladders are generally annular in shape when wrapped around the extremity and may be fabricated out of flexible sheet material such as a 12 gage frosty clear, 2-S hand polyvinyl-chloride. In the preferred embodiment the bladder material is substantially inelastic. When hydraulically pressurized the bladder expands primarily by filling the bladder and maximizing its volume. Elastic expansion of the bladder material is considered to be minimal. The overlap of each bladder with the adjacent bladder functions to smooth out the compression wave created by the sequential pressurizations of the compression bladders.

FIG. 5 shows the pressure sensors 76 mounted on the circuit board 106 hydraulically connected to the prefill bladders 56 by way of the tubes 78 and connecting points 108, and nipples 110 which extend into the interior 111 of the prefill bladders 56. The compartments 42, 44 are sized for the prefill bladders 56 and allow an overlap of adjacent prefill bladders. The circuit board 106 on which the pressure sensors 76 are mounted may be attached to the outside surface 92 of the compression unit 24 by any suitable means such as straps or hook and loop material.

FIG. 6 shows two of the prefill control valves 72 and two of the compression control valves 70 connected in the flow lines 66 to control the communication between the bladders and the manifold 64. Flow lines 66 connect to the nipples 110 at the connecting points 102. The flow lines may be fabricated from plastic tubing such as the TYGON ® brand manufactured by Norton Performance Plastics Corporation, P.O. Box 3660, Akron, Ohio 44309-3660.

FIGS. 7A, 7B, 7C and 7D comprise a schematic diagram of the control processor unit. The heart of the circuitry is a 68HC11E2FN microcontroller manufactured by Motorola and designated by the numeral 116. The control processor unit 26 monitors signals from the pressure sensors 76 and generates control signals in accordance with the provided programming to the microcontroller 116 for operating the pump unit 28B, the compression control valves 70, the prefill control valves 72, and the three-way valves 81, 82. The pressure sensors 76 connect to connector CON1 118 to provide the input for the microcontroller 116. An appropriate pressure sensor is a Model 1210B-002G-3L sensor manufactured by ICSensors located at 1701 McCarthy Blvd., Milpitas, Calif. 95035-7416. Each pressure sensor has a connected instrumentation amplifier manufactured by Linear Technology, Model LT1101CS shown in FIG. 7D set at a gain of 100 to provide amplified pressure signals to the analog digital inputs to the microcontroller via signal lines 124 as shown on FIG. 7A. Regulated 5 volt DC power for the pressure sensors 76 and the instrumentation amplifier is provided by a conventional 78L05 regulator chip also shown in FIG. 7D.

An 8 MHz crystal oscillator 128 sets the clocking speed for the microcontroller 116. The microcontroller 116 controls the prefill control valves 72 by way of signal lines 132 which go to metal-oxide-semiconductor-field-effect-transistor (MOSFET), switches 136 which switch on the light emitting diodes (LED's) for providing indicator lights. The signal lines 132 also connect to high-power MOSFETS 138 such as an IRF510 available from Motorola or other conventional sources. The high-power MOSFETS 138 connect to connector 142 on the schematics. The connector 142 mates with a cooperating connector, not shown, and connects to the cable 62 which goes to the prefill control valves 72 on the compressor unit 24. An appropriate valve for the prefill control valves would be an ASCO Model AL4112 available through Angar Scientific Company Inc., 52 Horse Hill Road, Cedar Knolls, N.J. 07927-2098.

Figure 7A:
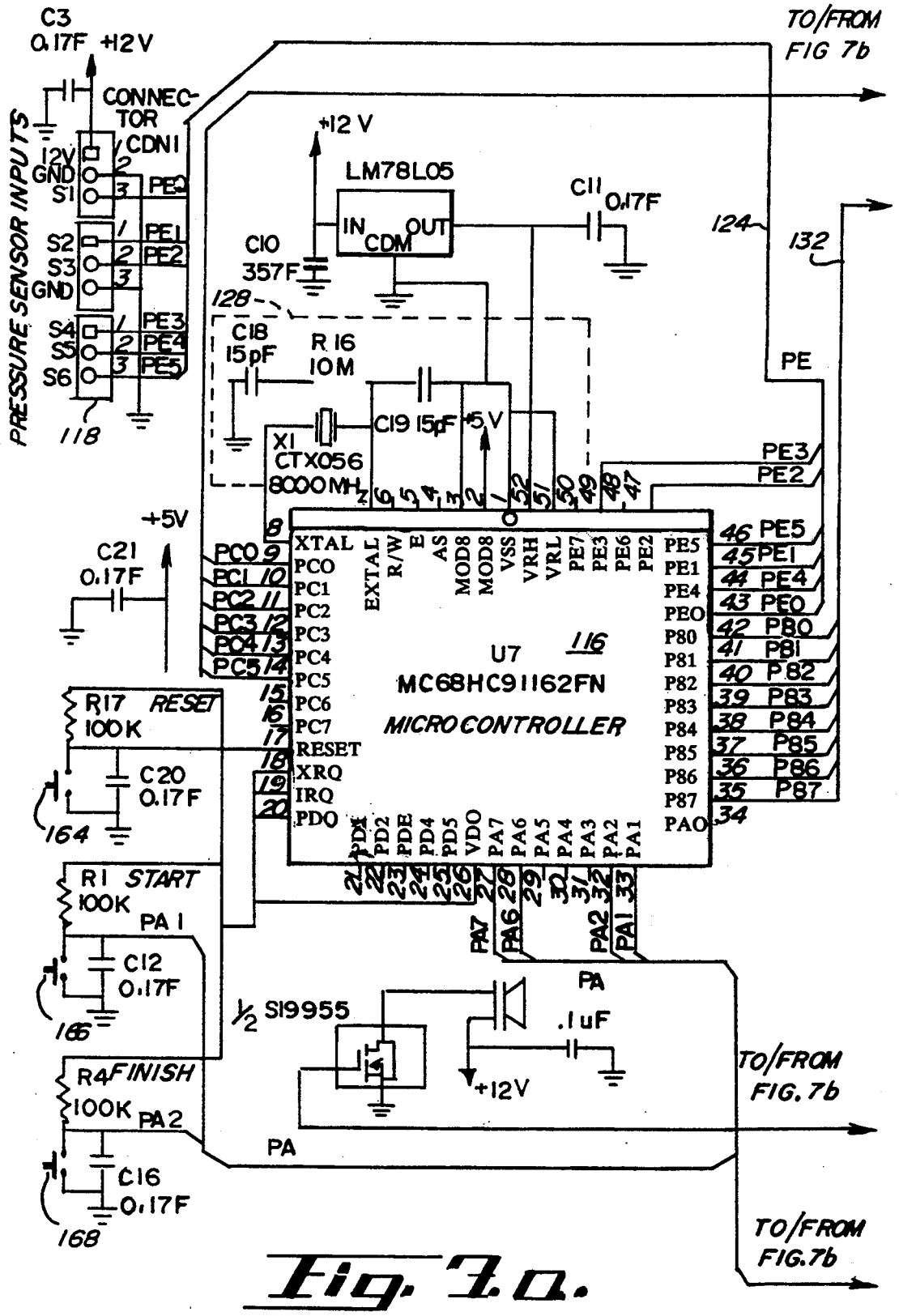
FIGS. 7A, 7B, and 7C shows a schematic diagram of the control processor unit.
Figure 7B:
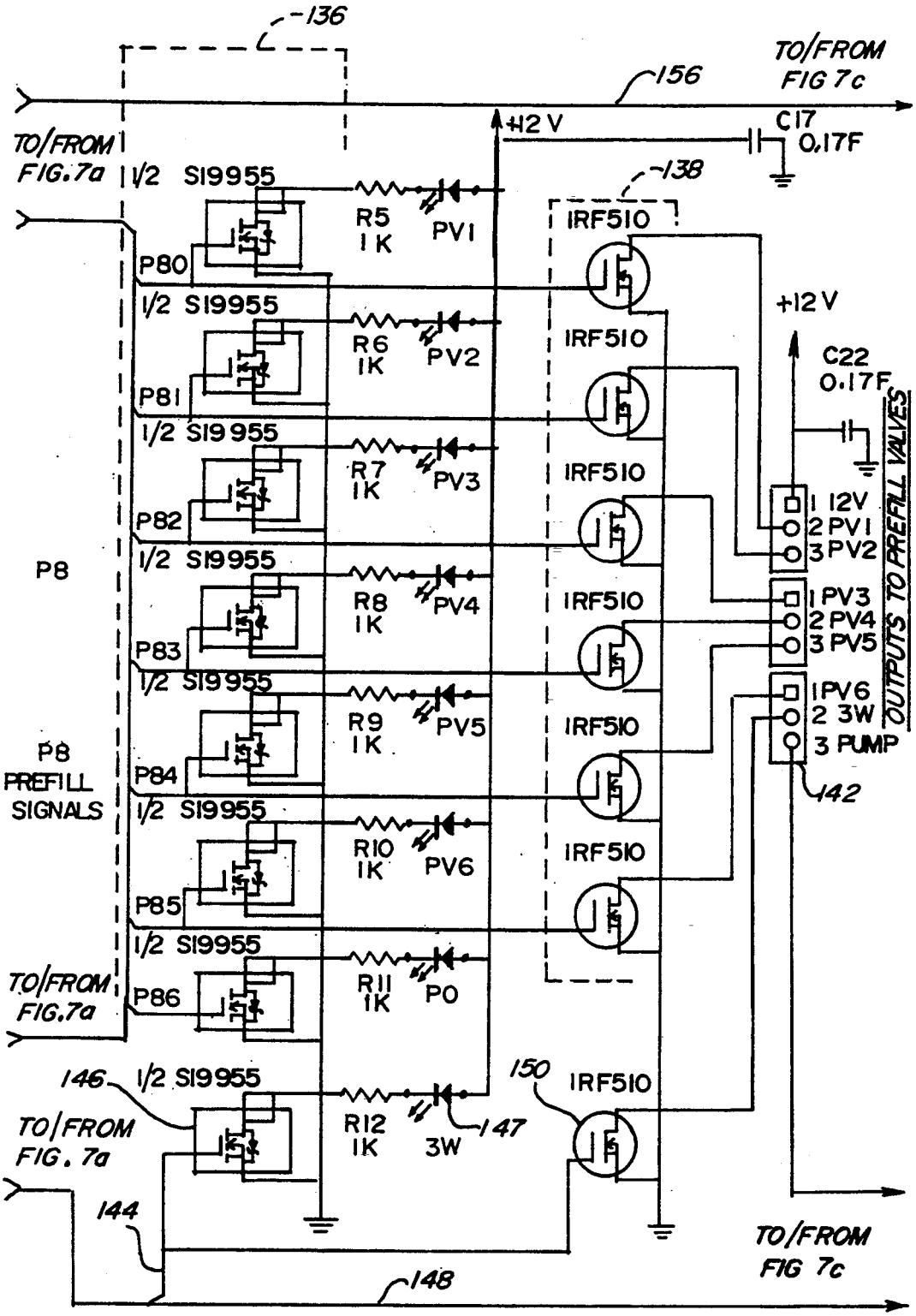
Figure 7C:
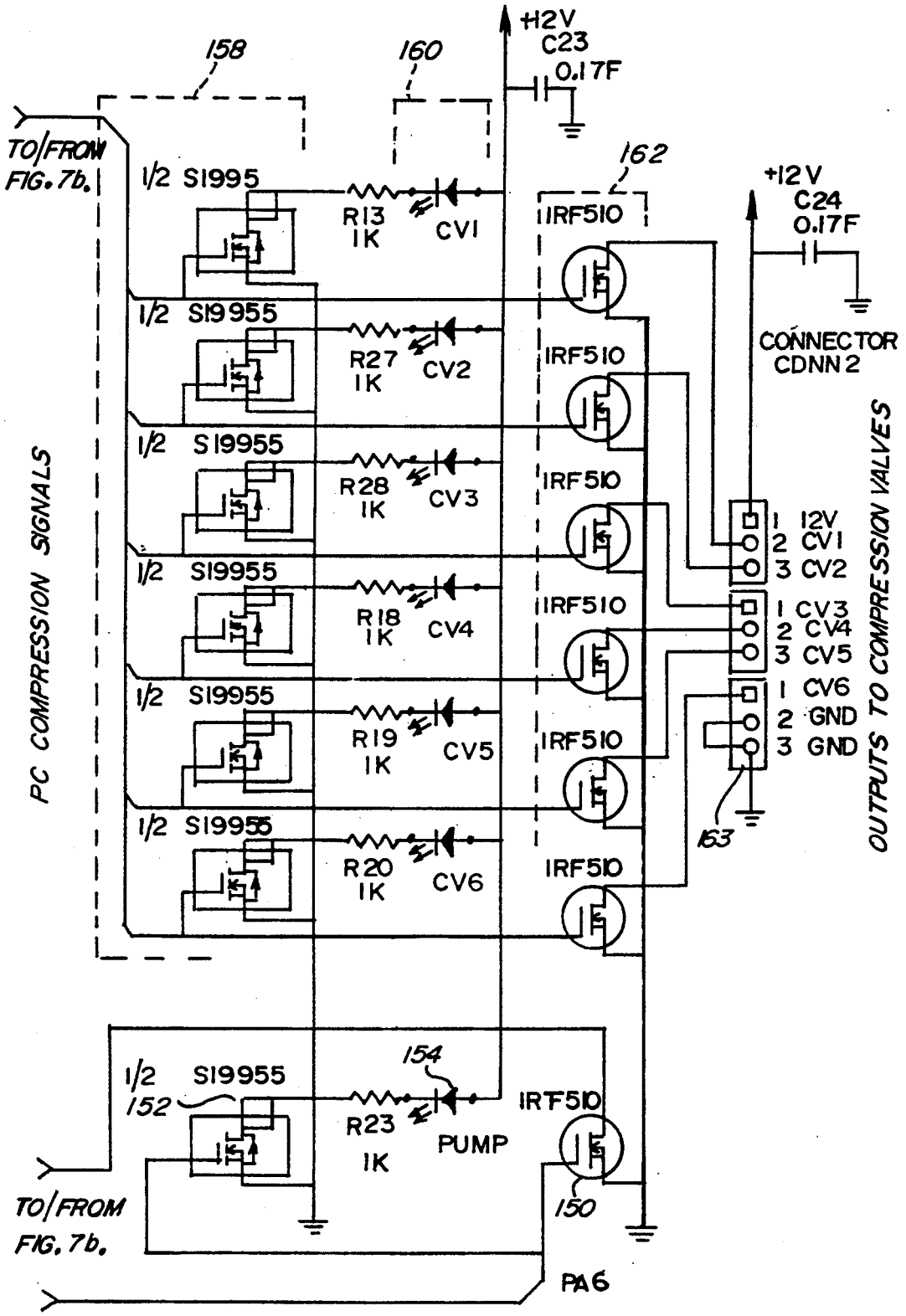
Figure 7D:
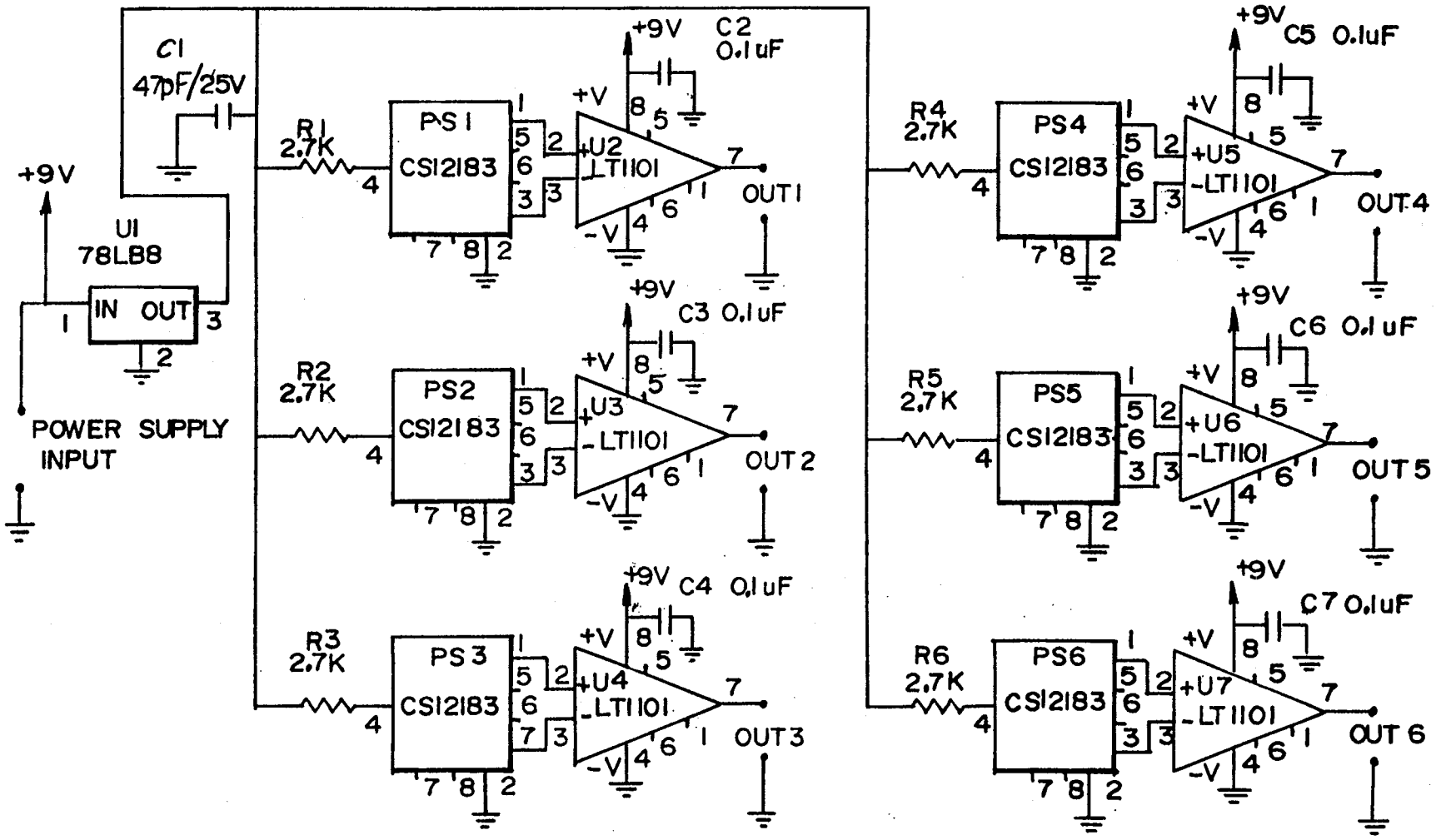
FIG. 7D shows a schematic of the pressure sensor circuitry.

Continuing to refer to FIGS. 7A, 7B and 7C, output from the microcontroller 116 controls the three-way valves 81, 82 by way of signal lines 144 going to the MOSFET 146 to operate the LED's 147 as an indicator light and additionally to the high-power MOSFET 150 which then goes to the connector 142. The connector 142 mates with a cooperating connector, not shown, that connects to cabling which goes to the 3-way valves. The suitable three-way valves, Model No. D311 manufactured by SIRAI Elettromeccanica, located at Strada Per Cernusco, 19-20060 Bussero-Milano, Italy.

Additionally, the pump unit 28 which is comprised of a hydraulic motor, not specifically shown, which is operated by the microcontroller 116 by way of a signal line 148 which controls the high-power switching MOSFET 150 with an output connected to connector 142. Said signal line 148 also goes to a switching MOSFET 152 connected to a light-emitting diode 154 to provide an indicator signal as to when the pump is operating. A suitable hydraulic motor is a TUFFY TM Jr. Series 1000 pump available from Smart Products, Inc. 2365 Paragon Drive, Unit H, San Jose, Calif. 95151.

The circuitry for the compression control valves 70 is similar to that for the prefill control valves 72. Signal lines 156 control the MOSFETS 158 which operate the LED's which provide an indicator signal as to which control valves are operating. The compression control valve signal line 156 also connects to the high-power MOSFETS 162 which then output to the connector 163 on the schematic. The MOSFETS that control the light emitting diodes may be a Si995504 manufactured by Siliconix Incorporated.

Push button switches 164, 166, 168 shown on FIG. 7A control the operation of the extremity pump apparatus 20 by way of activating the microcontroller. The power to the apparatus may be provided by a 12 volt battery source offering portability or other suitable conventional 12 volt power supply.

FIG. 7B also shows an audio beeper switched by a MOSFET connected to an output of the microcontroller 116. The microcontroller can be programmed to provide an audio signal upon the occurrence of any particular sensing parameters, such as an increase in pressure due to edema, or to signal a specific function of the apparatus, such as the pump unit start up.

Figure 8:
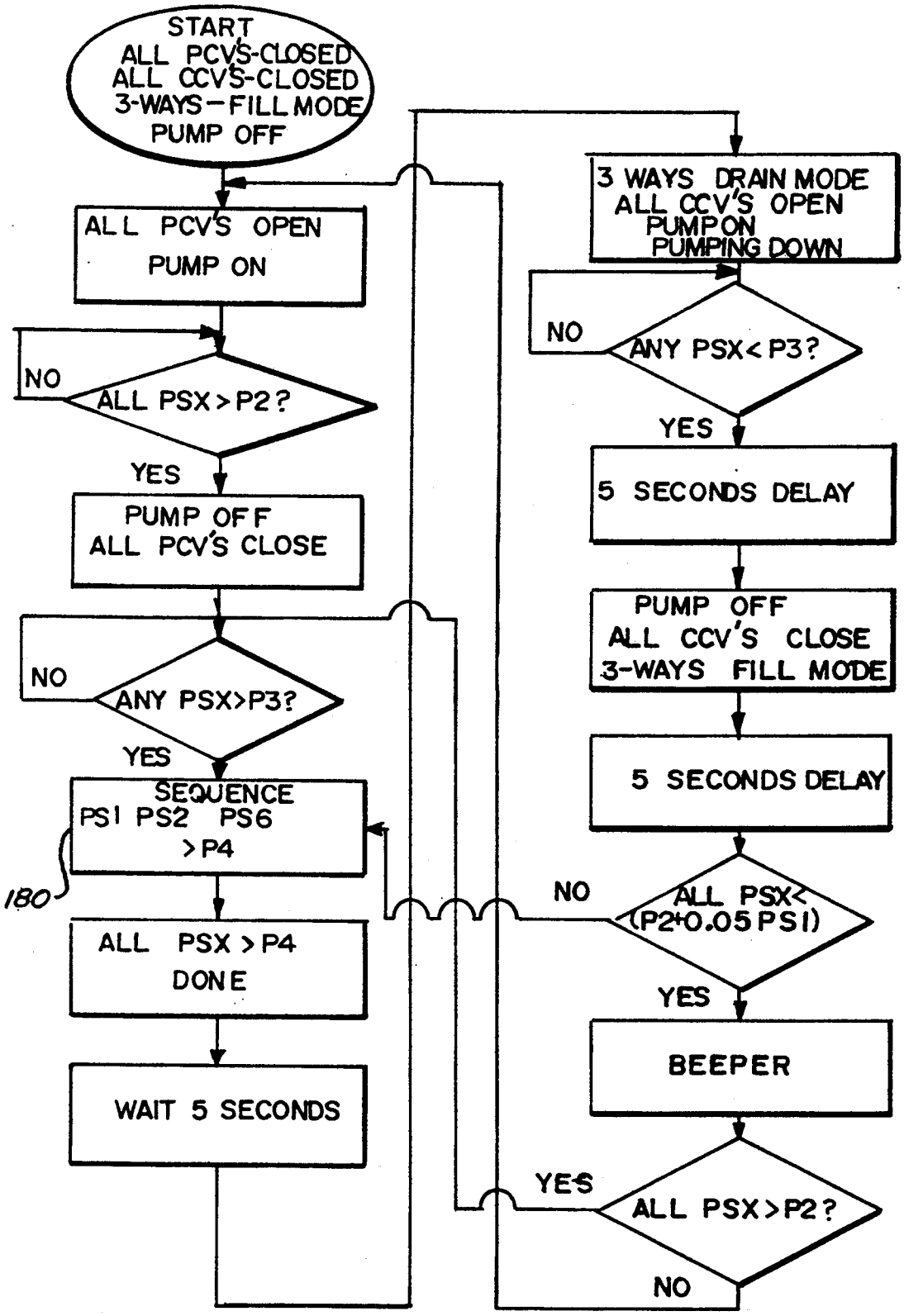
FIG. 8 shows a flow chart diagram of a suitable program for the microcontroller.

The 68HC11E2FN microcontroller 116 is conventionally programmed as desired to perform the various functions. Technical specification and programming instruction are available in the technical data book for the 68HC11EFN available from Motorola Literature Distribution, P.O. Box 20912, Phoenix, Ariz. 85036. One suitable program would follow the flow diagram of FIG. 8.

The flow diagram is generally self-explanatory. Necessary inputs would be the pressure parameters P2, P3, and P4. P2 refers to the prefill bladder pressure which molds the compressor unit 24 to the extremity. P3 refers to the pressure level which is specified to indicate an occurrence of edema. P4 is the compression pressure, that is, the pressure level in the prefill bladder when the extremity is compressed. SX and S1, S2, S3, S4, S5, S6 refer to the pressure level measurements from the pressure sensors 76. Note that sequential operation of the compression bladders 58 commencing with the most distal bladder and proceeding to the most proximal bladder occurs in box 180 under "sequence."

The extremity pump apparatus 20 operates as follows: Referring to FIGS. 4 and 1, the compression unit 24 is wrapped around and secured to an individual's extremity. The zipper strip 88 is engaged with the appropriate cooperating zipper strip 98 to facilitate a snug fit around the extremity. Flap 90 closes to cover the valves, tubing, and sensors on the compression unit. With power applied to the unit, the unit is activated. Controlled by the microcontroller 116, the hydraulic motor is turned on, prefill control valves 72 open and the three-way valves 81, 82 are set to a fill position or mode to direct the hydraulic fluid to the bladders from the pump unit 28. The prefill bladders 56 are filled and thereby pressurized to a specified pressure as measured by the pressure sensors 76 at which point the prefill control valves 72 are then closed sustaining the pressure in the prefill bladders 56. In that the compression unit 24 and bladders encompass the extremity, the compressive pressure applied to the extremity is substantially the pressure in the adjacent prefill bladder. The extremity pump apparatus 20 is then ready to detect the existence of any increase in pressure indicating the existence of edema. An edema causes an increase in diameter of the extremity thus compressing outward the surrounding bladder causing an increase in the pressure levels in the bladders.

Upon sensing of a specified increase in pressure the pressurization sequence is commenced. The microcontroller operates to sequentially open the compression control valves 70 beginning with the control valve 70 attached to the most distal compression bladder. Each compression control valve 70 remains open until a specified compressive pressure is obtained in the respective prefill bladder as measured by the pressure sensors 76 and monitored by the control processor unit 26. The compression control valves are sequentially opened preceding up to the compression control valve positioned most proximally to create a compressive wave that moves proximally. After a specified delay the compression control valves 70 are then opened, the 3-way valves are switched to a drain position or mode to relieve the pressure from the compression bladders by way of pumping the fluid into the reservoir 30. After a specified delay the sequence is repeated.

Note that the pressure sensors 76 are utilized to both control the level of pressurization of the bladders and to detect any edema in the extremity. Each prefill bladder thus constitutes an edema sensing bladder.

The pressure sensors 76 monitor the edema intermediate each compression sequence. When the readings of the pressure sensors 76 are reduced to substantially the original or other specified pressure level indicating that the edema has been reduced, the compression sequences cease until further edema is sensed.

The pressure sensors in combination with the control processor unit thus constitutes an edema sensing or monitoring means.

The apparatus 20 may be programmed to provide a pressure gradient on the extremity where each prefill bladder has a pressure slightly higher than the adjacent more proximal prefill bladder. Correspondingly, the more distal veins and lymphatics are pressurized to a higher level than the more proximal veins and lymphatics. This gradient can be provided during the compression sequence and/or during the period the compression sequence is not occurring.

Notably the programmability of the device offers extreme flexibility in detection of desired pressure increases for detecting edema and in pressurizing the bladders to desired specified pressures. Additionally, extreme flexibility is provided in the timing of the compression sequences. The compression unit may be configured to extend beyond the calf area of the individual's leg, down to completely cover the lower extremity from any specified point. Similarly, the compression device may be configured and similarly utilized for the upper extremities.

For example, the invention may be practiced without the prefill bladders, utilizing only compression bladders with an initial pressurization to mold the compression unit around the extremity and then a second pressurization sequentially to each compression bladder to provide the compression wave, the pressure sensors would be connected to the compression bladders in such a configuration.

Significantly, the control unit constitutes a signal means whereby any number of different signals may be generated when an edema is detected. For example, the signal may activate the compression sequence, or may activate an alarm or the beeper as shown in FIG. 7A.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. An extremity pump apparatus for providing compression to an extremity, the apparatus comprising:

a) a pump unit for providing a fluid under pressure;

b) a compression unit comprised of a flexible material configured to wrap around and engage an extremity, the compression unit comprising:

i) a plurality of prefill bladders arranged sequentially along the extremity, the prefill bladders each connected to the pump unit, the prefill bladders expandable when pressurized, whereby the compression unit molds around the extremity; and ii) a plurality of compression bladders arranged sequentially along the extremity, the compression bladders each connected to the pump unit, each compression bladder substantially contained within a prefill bladder, the compression bladders expandable when pressurized whereby the extremity is compressed.

2. The apparatus of claim 1 further comprising a means of selectively pressurizing the compression bladders.

3. The apparatus of claim 1 further comprising a separate valve for each bladder and further comprising a control processor, each valve inserted intermediate the pump unit and the respective bladder, each valve connected to the control processor, the control processor configured to activate the valves for sequential pressurization of the compression bladders.

4. The apparatus of claim 1 further comprising a pressure sensor positioned within a prefill bladder, said bladder coupled with the extremity whereby any edema in the extremity which causes an increase in the diameter of the extremity causes an increase in the pressure in said bladder, and wherein the pressure sensor responsive to detect an increase in pressure in said bladder caused by the edema.

5. The apparatus of claim 4 further comprising a control processor unit connected to the pressure sensor, the control processor configured to activate the pump unit upon the sensing of an increase in pressure at the pressure sensor indicative of edema.

6. The apparatus of claim 1 further comprising an edema sensing bladder, a pressure sensor connected to said edema sensing bladder, and a signal means for generating a signal connected to the pressure sensor, said bladder coupled with the extremity wherein an edema in the extremity causes an increase in the pressure in said bladder, whereby a signal is generated by the signal means upon occurrence of an edema.

7. The apparatus of claim 3 further comprising an edema sensing bladder, a pressure sensor connected to said edema sensing bladder, the pressure sensor connected to the control processor, said bladder coupled with the extremity wherein an edema in the extremity causes an increase in the pressure in said bladder, the control processor further configured to activate the pump unit upon the sensing of edema.

8. The apparatus of claim 1, wherein the pump unit is hydraulic and the device is portable.

9. An extremity compression apparatus for application on an extremity, the device comprising:

a. a flexible compression unit to wrap around and engage an extremity, the compression unit comprised of a bladder configured to extend circumferentially around the extremity, the bladder expandable when pressurized, whereby the extremity is compressed;

b. a pump unit for pressurization and expansion of the bladder, the pump unit connected to the bladder;

c. a valve inserted intermediate the pump unit and the bladder, the valve operational for controlling the pressurization of the bladder;

d. an edema monitoring means attached to the compression unit for detecting edema on the extremity; and e. a control processor unit connected to the edema monitoring means, the pump unit and the valve, the control processor configured to operate the valve and the pump unit upon the sensing of edema in the extremity.

10. The apparatus of claim 9 further comprised of a plurality of bladders sequentially arranged along the extremity, and a plurality of valves, with at least one valve for each bladder, each bladder connected to the pump unit through the respective valves, the valves connected to the control processor and wherein the control processor is further configured to operate the valves for sequential pressurization of bladders.

11. The apparatus of claim 9, wherein the pump unit is hydraulic and the apparatus is portable.

12. A hydraulic extremity compression apparatus for application on an extremity, the device comprising:

a. a flexible compression unit to wrap around and engage an extremity;

b. a plurality of prefill bladders, each prefill bladder is configured and positioned in the compression unit to extend circumferentially around the extremity, the prefill bladders sequentially and vertically arranged in the compression unit, the bladders expandable when hydraulically pressurized;

c. a plurality of compression bladders sequentially and vertically arranged in the compression unit, each compression bladder substantially contained within a prefill bladder, the compression bladders expandable when hydraulically pressured;

d. a pump unit for hydraulic pressurization and expansion of the prefill bladders and the compression bladders, the pump unit connected to the bladders;

e. a fluid source connected to the pump;

f. a plurality of valves with at least one valve inserted intermediate the pump unit and each bladder, the valves operational for controlling the hydraulic pressurization of the bladders;

g. a control processor connected to the valves for controlling the hydraulic pressurization of the bladders.

13. The apparatus of claim 12 further comprising a plurality of pressure sensors with at least one of the pressure sensors positioned in each prefill bladder, the pressure sensors connected to the control processor, and wherein the control processor is further configured to operate the valves based on the pressure sensed by the pressure sensors.

14. The apparatus of claim 12 further comprising a plurality of pressure sensors with at least one of the pressure sensors positioned in each compression bladder, the pressure sensors connected to the control processor, and wherein the control processor is further configured to operate the valves based on the pressure sensed by the pressure sensors.

15. The apparatus of claim 12 wherein the apparatus is portable.

16. The apparatus of claim 13, wherein the control processor is further configured to operate the valves to provide sequential pressurization of the compression bladders.

17. The apparatus of claim 14, wherein the control processor is further configured to operate the valves to provide sequential pressurization of the compression bladders.

18. The apparatus of claim 12 further comprising an edema sensing bladder, a pressure sensor connected to said edema sensing bladder, the pressure sensor connected to the control processor, said bladder coupled with the extremity wherein an edema in the extremity causes an increase in the pressure in said bladder, the control processor further configured to activate the pump unit upon the sensing of an increase in pressure.

* * * * *